US012129672B2

(12) United States Patent
Rossart

(10) Patent No.: US 12,129,672 B2
(45) Date of Patent: Oct. 29, 2024

(54) DEVICE AND METHOD FOR FORMING VOIDS IN CONCRETE

(71) Applicant: Raise the Bar Detailing, Port Ludlow, WA (US)

(72) Inventor: Raelene Marie Rossart, Port Ludlow, WA (US)

(73) Assignee: Raise the Bar Detailing, Port Ludlow, WA (US)

( * ) Notice: Subject to any disclaimer, the term of this patent is extended or adjusted under 35 U.S.C. 154(b) by 134 days.

(21) Appl. No.: 17/393,337

(22) Filed: Aug. 3, 2021

(65) Prior Publication Data

US 2022/0042328 A1 Feb. 10, 2022

Related U.S. Application Data

(60) Provisional application No. 63/214,565, filed on Jun. 24, 2021, provisional application No. 63/060,795, filed on Aug. 4, 2020.

(51) Int. Cl.
*E04G 15/04* (2006.01)

(52) U.S. Cl.
CPC ..... *E04G 15/04* (2013.01)

(58) Field of Classification Search
CPC ..... E04G 15/04; E04G 15/063; E04G 15/061
See application file for complete search history.

(56) References Cited

U.S. PATENT DOCUMENTS 1,045,562 A * 11/1912 Kennedy ..... E04B 1/4121 52/708
1,396,280 A * 11/1921 Paine ..... E04G 15/063 249/35
1,665,573 A * 4/1928 Wheeler, Jr. ..... E04G 15/063 249/59
2,234,784 A 3/1941 Stolz
2,728,126 A 12/1955 Whitlock
3,276,176 A * 10/1966 Karl ..... E04G 15/061 52/220.8
3,500,607 A * 3/1970 Wilson ..... E04B 1/4164 52/99
3,744,208 A * 7/1973 Spanel ..... E04G 15/061 52/127.3
3,933,336 A 1/1976 Tolf, Jr.
4,079,912 A * 3/1978 Haydock ..... B28B 7/30 249/43
5,134,828 A * 8/1992 Baur ..... E04B 1/4157 52/704
5,156,755 A 10/1992 Cass (Continued)

*Primary Examiner* — Rodney Mintz
(74) *Attorney, Agent, or Firm* — Seed IP Law Group LLP

(57) ABSTRACT

A device for forming a void in cured concrete, the device including a circular base with at least one hole through the base, an elongate rod coupled to the base, and a sleeve with a longitudinal axial bore extending from a first end of the sleeve to and through a second end of the sleeve, the axial bore sized and shaped to receive the elongate rod in slidable engagement within the axial bore and a length of the sleeve being greater than or equal to a length of the elongate rod. The base is coupled to concrete formwork and concrete is poured over the sleeve and the elongate rod and allowed to cure. The rod is removed from the sleeve and the sleeve is removed from the cured concrete to form the void in the cured concrete.

17 Claims, 14 Drawing Sheets

(56) References Cited

U.S. PATENT DOCUMENTS 5,634,311 A * 6/1997 Carlton ..... F16L 25/0045 52/220.8
5,934,821 A * 8/1999 Shaw ..... E01C 11/14 52/704
6,645,342 B2 * 11/2003 Scott ..... E04G 15/061 264/318
7,076,924 B2 * 7/2006 Thompson ..... E04G 15/061 52/704
7,487,949 B2 * 2/2009 Bennett ..... B28B 7/342 249/177
7,874,762 B2 * 1/2011 Shaw ..... E01C 19/504 52/700
7,905,680 B2 * 3/2011 Albritton ..... E01C 11/14 404/62
8,707,641 B2 4/2014 Rummelhoff
D735,366 S 7/2015 Mide et al.
9,340,969 B1 * 5/2016 Shaw ..... B28B 1/14
9,617,694 B2 * 4/2017 Shaw ..... E04G 17/06
10,100,511 B2 * 10/2018 Boyd ..... E04B 1/483
10,603,815 B2 * 3/2020 Gonzalez ..... E04G 15/063
10,975,567 B2 * 4/2021 Brown ..... E04G 15/061
11,578,491 B2 * 2/2023 Shaw ..... E04C 5/0645
2003/0168167 A1 * 9/2003 Scott ..... E04G 15/061 156/701
2004/0079043 A1 * 4/2004 Scott ..... B28B 7/342 52/576
2004/0111992 A1 * 6/2004 Bennett ..... E01C 11/14 52/380
2005/0044809 A1 * 3/2005 Thompson ..... E04B 1/4114 52/223.13
2009/0060657 A1 * 3/2009 Albritton ..... E01C 11/14 404/83
2013/0020460 A1 * 1/2013 Von Rummelhoff ..... B28B 7/30 249/142
2015/0336289 A1 * 11/2015 Comerford ..... B28B 7/18 264/317
2016/0298329 A1 * 10/2016 Thompson ..... E04B 1/043
2018/0258653 A1 * 9/2018 Gonzalez ..... B28B 7/306
2019/0024367 A1 1/2019 Shaw
2019/0257082 A1 8/2019 Brown et al.
2021/0245394 A1 * 8/2021 Rossart ..... E04B 1/383
2021/0246657 A1 * 8/2021 Shaw ..... E04C 5/0645

* cited by examiner

DEVICE AND METHOD FOR FORMING VOIDS IN CONCRETE

BACKGROUND

Technical Field

The present disclosure is directed a device and method for forming voids in concrete and, more particularly, to an insert that is removed from cured concrete to create a void in the cured concrete.

Description of the Related Art

It is common in the construction industry to complete concrete structures in multiple stages or phases, wherein each phase may include one or more pours of concrete. Typically, the pours are required to be connected, or joined together, with reinforcing bars in order to satisfy structural requirements. However, because prior pours consist of cured, hardened material, creating a sufficient connection between pours can be a challenge. While certain methods exist for joining pours, these existing methods suffer from several deficiencies.

One known method is to use a threaded rebar coupler attached to concrete formwork inside the first pour such that reinforcing bars for the second pour can be attached to the coupler. However, the issue with this method is that there are some concrete structures that require reinforcing bars in a second or subsequent pour that are not straight. Spinning a bent bar into the threads of the coupler in the first pour is not always possible. This method can also be prohibitively expensive for budget-constrained projects.

A second method is to wait for the first pour of concrete to cure and then drill holes into the cured concrete. Once the holes are drilled, an approved epoxy resin can be used to secure the reinforcing bars for the second pour into the first pour. While this may account for bent bars to some degree, this method suffers from additional issues. For example, drilling the holes can be time-consuming, can damage reinforcing bars in the first pour, and drilling might not even be allowed in conjunction with certain types of structures, such as post-tensioned concrete structures. Further, certain regulatory agencies, such as the Occupational Safety and Health Administration ("OSHA") have issued new rules regarding the drilling process because silica dust created by concrete drilling has been deemed a health risk to those around drilling operations. In order to avoid violation of these new rules, additional equipment may need to be used in conjunction with time-consuming procedures to protect the health of those who are in close proximity to the area of concrete drilling operations.

BRIEF SUMMARY

One or more implementations of a device for forming a void in concrete are provided that include a tube having a first end and a second, opposite end and a length between the first end and the second end. The tube is structured to expand and contract between a collapsed configuration with a shorter length and an expanded configuration with a longer length. The device further includes a support extending along at least a first portion of the length of the tube. The tube is structured to be attached to concrete formwork in a collapsed configuration and then expanded to the expanded configuration to be removed from the concrete after it has cured.

The implementation may further include the tube having a plurality of ridges along at least a second portion of the length of the tube with the tube configured to expand and contract between the collapsed configuration and the expanded configuration via the plurality of ridges. In some implementations, the device further includes an axial bore extending into the tube and a base plate coupled to the tube. The base plate may also be referred to as a flange and may include a plurality of holes through the base plate structured to receive fasteners to couple the base plate to the concrete formwork. The support may be a support rod coupled to the base plate with the support road having a fixed length. In one or more implementations, the support is a connection strip extending along an outer surface of the tube that includes at least two of the plurality of ridges coupled together. The connection strip may also be a strip of material coupled to the plurality of ridges along the length of the tube.

One or more implementations of a device for forming voids in concrete includes an elongate body having a length with an axial bore extending along at least a portion of the length of the elongate body. A base plate is coupled to the elongate body and the device further includes a first support coupled to the base plate and positioned in the axial bore of the elongate body.

In some implementations, the device further includes the length of the elongate body being configured to expand between a contracted configuration and an expanded configuration with the first support extending in the axial bore along a majority of the length of the elongate body in the contracted configuration. The elongate body also has an outer surface and further includes a plurality of ridges extending along the outer surface of the elongate body. The device may further include a second support including at least two of the plurality of ridges of the elongate body fused together. The second support may also be a strip of material coupled to a portion of the plurality of ridges.

In one or more implementations, the device further includes a coupling rod coupled to the elongate body and the first support, the first support having a first diameter and the coupling rod having a second diameter less than the first diameter of the first support. The length of the elongate body is configured to be adjustable between a contracted configuration and an expanded configuration and the coupling rod is configured to break in response to the length of the elongate body expanding from the contracted configuration to the expanded configuration.

One or more implementations of a device for forming voids in concrete includes a body having a first end and a second end and a length between the first end and the second end. The body includes a plurality of ridges extending from the body along at least a portion of the length with the body configured to be adjustable between an extended and retracted configuration via the plurality of ridges. An axial bore extends into the body from the first end and the device further includes a reinforcing strip including at least two of the plurality of ridges fused together. The reinforcing strip is configured to break in response to the body adjusting from the retracted configuration to the extended configuration.

In some implementations, the device further includes a base plate coupled to the body and a support cylinder coupled to the base plate and positioned in the axial bore of the body. The support cylinder extends in the axial bore along a majority of the length of the body. The device may further include a coupling element coupled to the support cylinder and the body. The reinforcing strip may also extend along the length of the body and include a portion of each of the plurality of ridges.

One or more implementations of a device for forming voids in concrete includes a base coupled to an elongate rod extending from the base in an axial direction and a sleeve removably positioned on the rod. The device is placed in uncured concrete and the concrete cures around the device and the sleeve. Once the concrete cures, the rod can be removed from the sleeve first and then the sleeve can be removed from the concrete second to assist with forming a void in the concrete.

One or more further implementations of a device for forming a void having a diameter in cured concrete includes a circular base having at least one hole through the base and an elongate rod coupled to the base having a length along an axial direction between a first end and a second end opposite to the first end of the elongate rod. The first end of the elongate rod is coupled to the base and the second end of the elongate rod is spaced from the base across the length of the elongate rod. The device further includes a sleeve having an axial bore through the sleeve in the axial direction, the sleeve resting on the elongate rod with the elongate rod received in the axial bore of the sleeve, the sleeve having a length along the axial direction between a first end and a second end opposite to the first end of the sleeve with the length of the sleeve being greater than or equal to the length of the rod and an air gap being between the rod and the sleeve.

In some implementations, the device further includes the air gap being between the elongate rod and sleeve over the length of the elongate rod and the length of the sleeve. Further, the at least one hole through the circular base includes only two holes and the elongate rod has a constant diameter over the length of the elongate rod and the sleeve has a constant diameter over the length of the sleeve. The device also includes the elongate rod being structured to be removed from the axial bore of the sleeve and the sleeve being structured to be removed from the cured concrete to leave the void in the cured concrete with the sleeve further structured to extend in the axial direction in response to a tensile force on the sleeve in the axial direction during removal of the sleeve from the cured concrete. The sleeve has an outer diameter equal to the diameter of the void in the cured concrete.

One or more implementations for forming a void in cured concrete includes a base having at least one hole through the base and a rod coupled to the base and extending from the base in an axial direction. A sleeve is positioned on the rod and has an axial bore through the sleeve with the rod positioned in the axial bore of the sleeve and internal to the sleeve. The rod is structured to be removed from the axial bore of the sleeve and the sleeve is structured to be removed from the cured concrete to leave the void in the cured concrete.

In some implementations, the device further includes the rod having a first length and the sleeve has a second length greater than or equal to the first length and the rod having a first diameter that is constant over the first length and the sleeve having a second diameter that is constant over the second length. The at least one hole includes only two holes and the base and the rod are a single, unitary, integral component and the sleeve is an independent component removably positioned on the rod. The device further includes an air gap between the rod and the sleeve and the rod having a first coefficient of friction and the sleeve having a second coefficient of friction less than the first coefficient of friction. The sleeve is structured to extend in the axial direction in response to a tensile force on the sleeve in the axial direction during removal of the sleeve from the cured concrete.

One or more implementations of a method for forming a void in cured concrete include placing a sleeve on an elongate rod, including positioning the elongate rod in an axial bore of the sleeve and internal to the sleeve with the sleeve resting on the elongate rod. In further steps, coupling a base connected to the elongate rod to concrete formwork and pouring concrete over the sleeve and the elongate rod and allowing the concrete to cure. Then, the method includes removing the elongate rod from the sleeve and removing the sleeve from the cured concrete to form the void.

In some implementations, the method further includes placing the sleeve on the elongate rod including positioning an outer peripheral edge of the sleeve coplanar with, or extending beyond, an outer peripheral edge of the elongate rod and placing the sleeve on the elongate rod including forming an air gap between the sleeve and the elongate rod with the air gap extending over a length of the sleeve and a length of the elongate rod. The method further includes removing the sleeve from the cured concrete including extending the sleeve in an axial direction and reducing an outer diameter of the sleeve in response to a tensile force on the sleeve in the axial direction and coupling the base to the concrete formwork including inserting a fastener through at least one hole in the base.

BRIEF DESCRIPTION OF THE SEVERAL VIEWS OF THE DRAWINGS

The foregoing and other features and advantages of the present disclosure will be more readily appreciated as the same become better understood from the following detailed description when taken in conjunction with the accompanying drawings, wherein.

DETAILED DESCRIPTION

Figure 1:
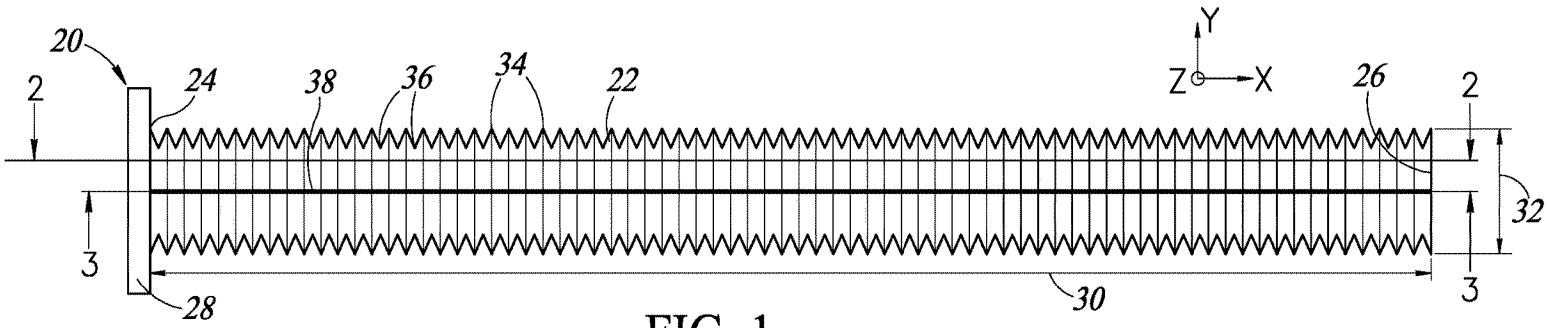
FIG. 1 is a side elevation view of an implementation of an insert for forming a void in concrete illustrated in a collapsed configuration according to the present disclosure.

In the following description, certain specific details are set forth in order to provide a thorough understanding of various disclosed implementations. However, one skilled in the relevant art will recognize that implementations may be practiced without one or more of these specific details, or with other methods, components, materials, etc. In other instances, well-known structures, components, or both, associated with concrete constituents, mixing, finishing, and concrete curing have not been shown or described in order to avoid unnecessarily obscuring descriptions of the implementations.

Unless the context requires otherwise, throughout the specification and claims that follow, the word "comprise" and variations thereof, such as "comprises" and "comprising" are to be construed in an open inclusive sense, that is, as "including, but not limited to." The foregoing applies equally to the words "including" and "having."

Reference throughout this description to "one implementation" or "an implementation" means that a particular feature, structure, or characteristic described in connection with the implementation is included in at least one implementation. Thus, the appearance of the phrases "in one implementation," "in some implementations," or "in an implementation" in various places throughout the specification are not necessarily all referring to the same implementation. Furthermore, the particular features, structures, or characteristics may be combined in any suitable manner in one or more implementations, and in which like reference characters designate the same or similar parts throughout the several views.

The present disclosure is directed to an insert for forming a void in concrete having a base plate and an elongate member extending from the base. The insert is coupled to concrete formwork, concrete is poured and cured, and the insert is removed, thus leaving a void. Preferably, the insert has a size and a shape to enable the void left by the insert to receive reinforcing bars, such that reinforcing bars for a subsequent concrete pour can be secured in the void, thereby allowing concrete pours to be joined together to achieve structural strength and integrity in a simple, safe, and efficient manner. However, the implementations of the present disclosure are also useful for any other application where holes are needed in a concrete pour, such as for pipes, conduits, air vents, or other utility applications. Further, the implementations of the present disclosure can be applied outside of the concrete context. As such, while the present disclosure will proceed to describe certain non-limiting examples of a concrete insert, it is to be appreciated that the present disclosure is not limited to the implementations shown and described herein.

FIG. 1 is a side view of an insert 20 for forming a void in concrete. The insert 20 is illustrated in a collapsed or retracted configuration. The insert 20 includes a tube 22 extending longitudinally in axial direction X with a first end 24 and an opposite second end 26. A base plate 28 is coupled to the first end 24 of the tube 22 and the second end 26 of the tube 22 is closed, as described in more detail herein. In some implementations, the second end 26 may be open. The tube 22 has a length 30 in the collapsed configuration shown in FIG. 1 from the first end 24 to the second end 26. The length 30 may be selected according to the desired length or depth of the void to be formed in the concrete by the tube 22. In other words, the length 30 in the collapsed configuration may be selected to be in the range of 1 through 36 inches, or more or less, in some implementations. The tube 22 further includes a diameter 32, which may similarly be selected according to the desired width or diameter of the void to be formed in the concrete. For example, the diameter may be selected to be any number in the range of 1 through 12 inches, or more or less, in some implementations. Although the tube 22 is illustrated as extending in a straight line and perpendicular to the base plate 28, in some implementations, the tube 22 is at an angle to the base plate 28 to allow forming voids in concrete at an angle in order to receive bent bars.

The tube 22 further includes a plurality of ridges 34 extending from the tube 22 and a corresponding plurality of recess 36 between the ridges 34. Although FIG. 1 is a side view, the opposite side of the insert 20 may be a mirror image, such that the ridges 34 and recesses 36 extend around the entire circumference of the tube 22. As shown in FIG. 1, the tube 22 includes the ridges 34 and recesses 36 extending along the complete length 30 of the tube 22. As will be described further below, the ridges 34 and recesses 36 allow the tube 22 to expand and contract between the collapsed configuration shown in FIG. 1 and an expanded configuration described with reference to FIG. 6.

In one or more implementations, the ridges 34 and recesses 36 do not extend along the entire length 30 of the tube 22, but rather, extend along only a portion of the length 30 of the tube 22, such as along half or a quarter, or more or less, of the length 30 of the tube 22. Further, there may be more than one portion with the ridges 34 and recesses 36 along the length 30, such as two, three, four or more portions with ridges 34 and recesses 36 spaced from each other along the length 30 of the tube 22.

Figure 2A:
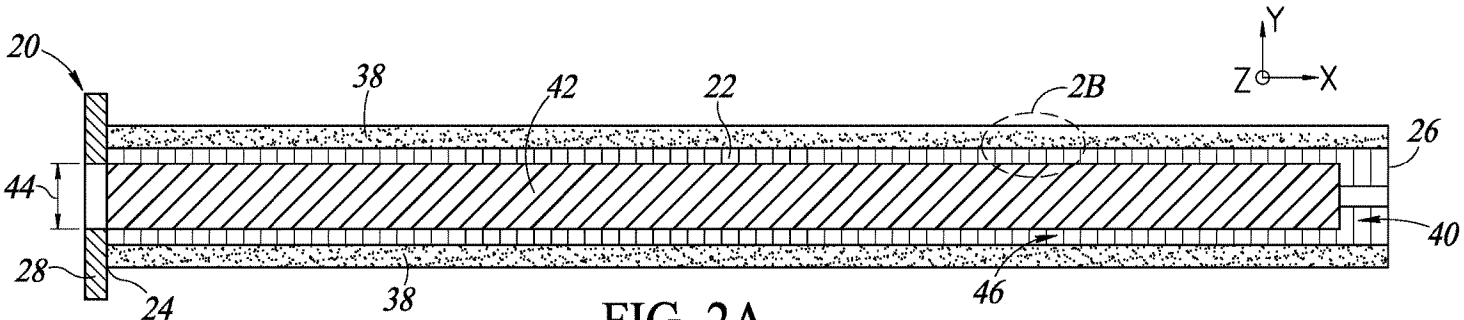
FIG. 2A is a cross-sectional view of the insert of FIG. 1 along line 2-2 in FIG. 1.

The tube 22 further includes a connection strip 38, which is shown more clearly in FIG. 2A. FIG. 2A is a cross-sectional view of the insert 20 along the line 2-2 in FIG. 1. More specifically, FIG. 2A is a top-down cross-sectional view along line 2-2 in FIG. 1. The connection strip 38 includes a portion of each of the plurality of ridges 34 described above with reference to FIG. 1 fused or coupled together to provide reinforcement during a concrete pour. In some implementations, the tube 22 is plastic, in which case, a portion of the ridges 34 along sides of the tube 22 are melted together to form the connection strip 38. However, where other materials are used for the tube 22, such as metal, the ridges 34 may be soldered or stamped together. As shown in FIG. 2A, the connection strip extends along the entire length 30 (FIG. 1) of the tube 22, or from the base plate 28 to the second end 26 of the tube 22. However, in some implementations, the connection strip 38 extends along only a portion or along only selected portions of the tube 22, similar to the ridges 34 and recesses 36 described above.

The insert 20 further includes a longitudinal axial bore 40 extending into the tube 22 along the longitudinal axial direction X from the first end 24 to the second end 26. A support 42 is coupled to the base plate 28 and extends in the axial bore 40. The support 42 may be a support rod made of a number of available materials, such as plastic, polyvinyl chloride, metal, wood, or others. The support 42 has a diameter 44 that is less than the diameter 32 (FIG. 1) of the tube 22. As such, there may be a space 46 between an outer surface of the support 42 and an inner surface of the tube 22. In some implementations, the space 46 is less than one inch, such as 0.25 inches, 0.5 inches, or 0.75 inches, or more or less. In one or more implementations, the outer surface of the support 40 is in contact with the inner surface of the tube 22, thus eliminating the space 46.

In some implementations, the axial bore 40 extends along an entirety of the length 30 of the tube 22 and the support 42 extends along a majority of the length 30 of the tube 22 in the collapsed configuration. In one or more implementations, the axial bore 40 extends less than the entire length 30 of the tube 22 and the support 42 extends less than a majority of the length 30.

Figure 2B:
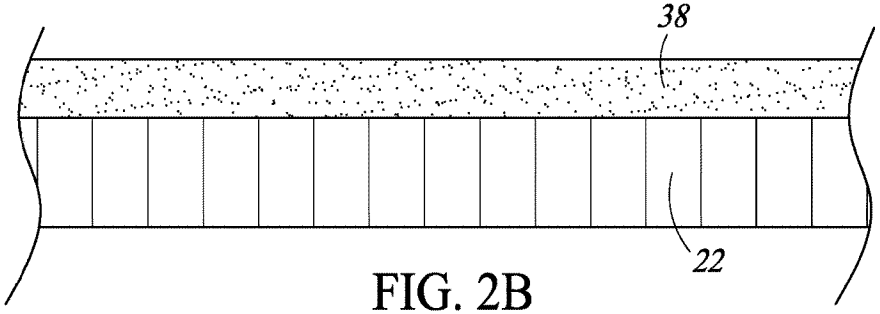
FIG. 2B is a detail view of a portion of a connection strip of the insert of FIG. 2A.

FIG. 2B illustrates the connection strip 38 in more detail. As described herein, the connection strip 38 includes a portion of the ridges 34 and valleys 36 melted or fused together to form a solid strip of material in some implementations. The connection strip 38 further reinforces the tube 22 during a concrete pour (i.e. when the tube 22 is in the collapsed configuration). Further, the tube 22 may include only one connection strip 38, or may include multiple connection strips 38 of any length and in any location relative to each other and the tube 22. In one non-limiting example, the tube 22 includes two connection strips 38 of equal length and on opposite sides of the tube 22. Further, the tube 22 may include three connection strips 38 oriented longitudinally along the tube 22 and spaced equally from each other and all spaced radially around the top half of the tube 22 with each strip 38 having a different length from the other strips 38. When the tube 22 is expanded to the extended configuration described herein, the connection strip 38 fails and breaks apart to allow the tube 22 to expand to the extended configuration.

Figure 3:
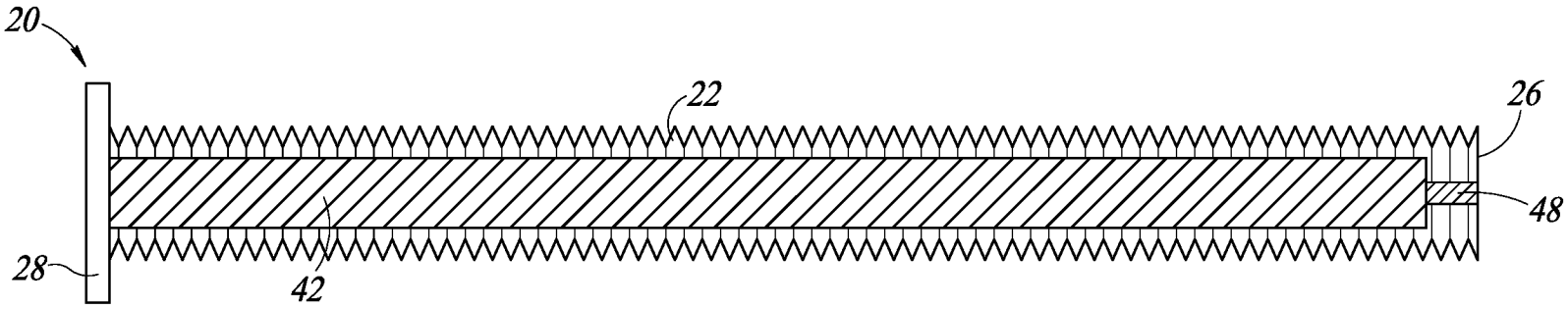
FIG. 3 is a cross-sectional view of the insert of FIG. 1 along line 3-3 in FIG. 1.

FIG. 3 is a cross-sectional view of the insert 20 along line 3-3 in FIG. 1. FIG. 3 illustrates that the insert 20 further includes an attachment strip 48 coupled to a terminal end of the support 42 and the second end 26 of the tube 22. In some implementations, the attachment strip 48 is formed as a single, continuous piece of material with the tube 22 and is coupled to the support 42 with adhesive, one or more fasteners, or by melting the attachment strip 48 to the support 42. In some implementations, the attachment strip 48 is formed as a single, continuous piece of material with the support 42 and is similarly attached to the second end 26 of the tube 22 with adhesive, one or more fasteners, or by melting the attachment strip 48 to the tube 22. In yet further implementations, the attachment strip 48, tube 22, and support 42 are all formed as a single, integral, unitary component through injection molding, extrusion blow molding, extrusion molding, vacuum forming, compression molding, or some other like process. In some implementations, the attachment strip 48 may be a separate component that is coupled to both the support 42 and the tube 22 with adhesive, one or more fasteners, or by melting the attachment strip 48 to the support 42 and the tube 22.

The attachment strip 48 may be a thin strip of plastic, with thin meaning that the cross-sectional area of the strip 48 is less than the cross-sectional area of the support 42, in some implementations. In one or more implementations, the attachment strip 48 is thicker than the support 42. The attachment strip 48 is designed to fail when the tube 22 is expanded to the extended configuration, as described herein. However, in the collapsed configuration shown in FIG. 3, the attachment strip 48 provides structural support to the insert 20 and more specifically, provides a connection between the support 42 and the tube 22. In some implementations, the attachment strip 48 is between the support 42 and the base plate 28 instead of between the support 42 and the second end 26 of the tube 22 as shown.

Figure 4:
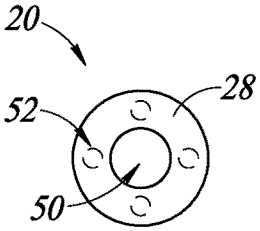
FIG. 4 is an end view of a first end of the insert of FIG. 1.

FIG. 4 is a left end view of the insert 20 that illustrates the base plate 28 in additional detail. The base plate 28 is circular or disc shaped in some implementations, although the base plate 28 can have any geometric or non-geometric planform shape in one or more other implementations. In some implementations, the base plate 28 includes a first hole 50 through the base plate that is aligned with the longitudinal axial bore 40 of the tube 22 (FIG. 2A) such that the hole 50 is in fluid communication with the axial bore 40. In some implementations, the first hole 50 is centrally arranged with respect to the base plate 28, although the first hole 50 can also be offset from the center of the base plate 28 in one or more implementations. Further, some implementations of the base plate 28 include at least one second hole, indicated in FIG. 4 by dashed lines 52. In the illustrated implementation, there are four second holes 52 spaced equidistant from each other about or around the hole 50 through the base plate 28. The second holes 52 are sized and shaped to receive fasteners to secure the base plate 28 to concrete formwork, as described herein. However, in other implementations that do not include the second holes 52, the base plate 28 is coupled to concrete formwork with fasteners directly through the base plate 28.

Figure 5:
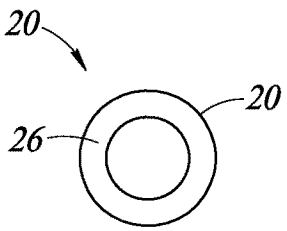
FIG. 5 is an end view of a second end of the insert of FIG. 1.

FIG. 5 is a right end view of the insert 20 that illustrates the second end 26 of the tube 22 in additional detail. As referenced above, the second end 26 of the tube 22 is closed in some implementations to prevent concrete from entering the tube 22. Further, in some implementations, the second end 26 of the tube 22 is flat and planar. However, the second end 26 of the tube 22 can also include one or more holes, apertures, cavities, or protrusions in some implementations.

Figure 6:
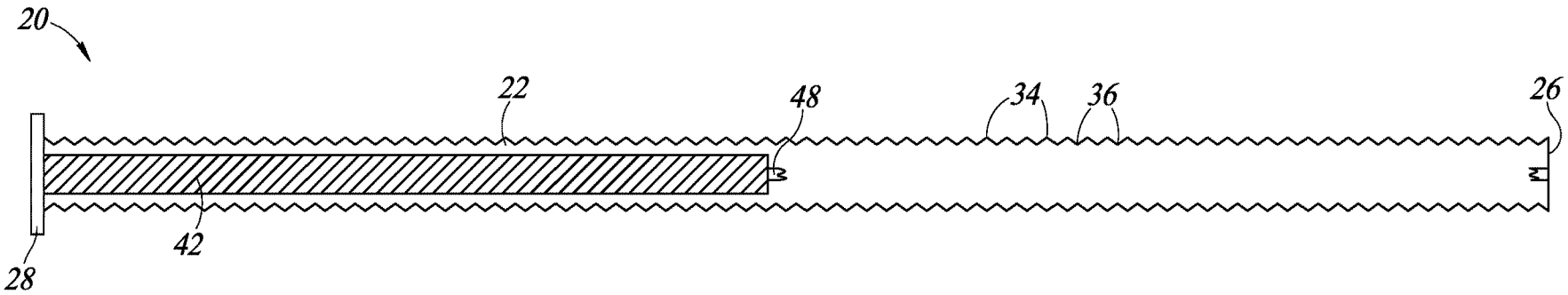
FIG. 6 is a cross-cross-sectional view of the insert of FIG. 1 in an expanded configuration.

FIG. 6 is a cross-cross-sectional view of the insert 20 in an expanded or extended configuration. In use, and as further described herein, a force is applied to the base plate 28 of the insert 20 to the left in the illustrated orientation. The force on the base plate 28 breaks the connection strip 38 and the attachment strip 48 and causes the tube 22 to expand to the extended configuration shown via the ridges 34 and recesses 36. The support 42 has a fixed length and is not extendable in some implementations, such that the support 42 moves with the base plate 28 upon application of the force to the base plate 28. The insert 20 can be returned to the collapsed configuration by applying an opposite force on the base plate 28, such that the insert 20 can be reusable in some implementations.

FIGS. 7-10 are side views of various process steps in an implementation of a method of forming a void in concrete according to the present disclosure.

Figure 7:
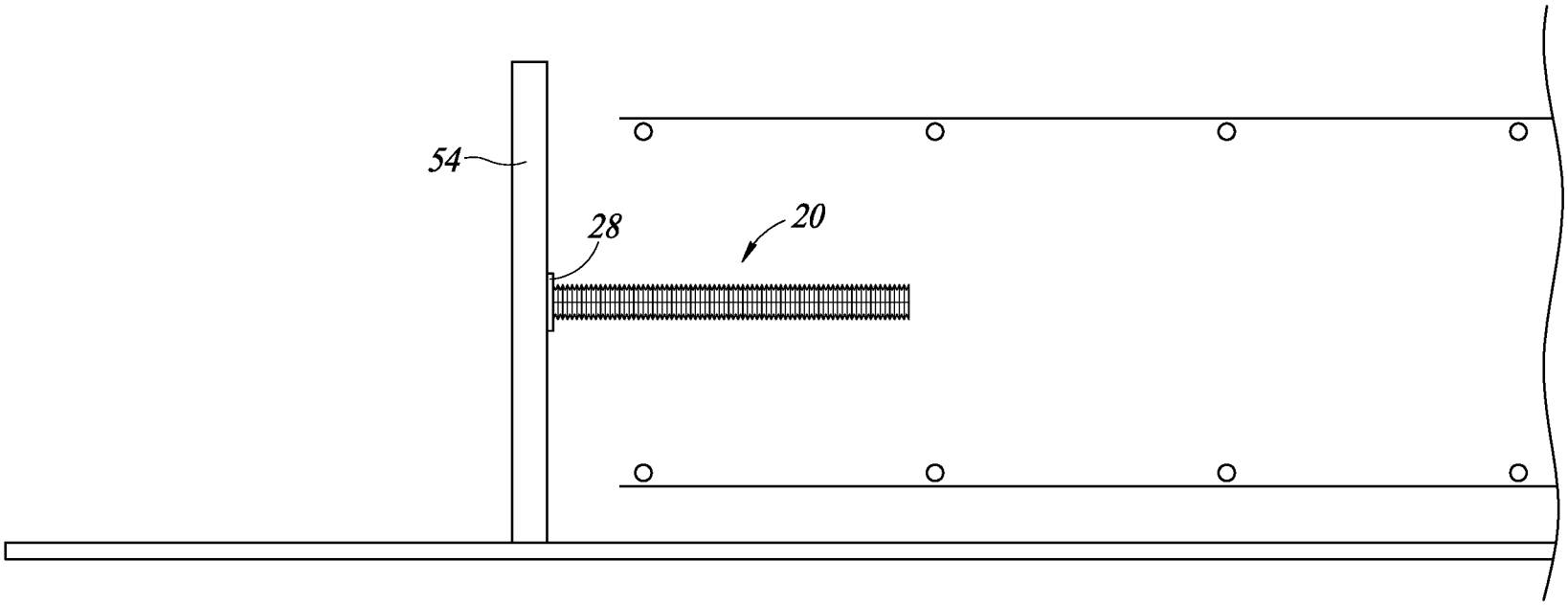
FIGS. 7-10 are side views of various process steps in an implementation of a method of forming a void in concrete according to the present disclosure.

Beginning with FIG. 7, the insert 20 is coupled to concrete formwork 54 in the collapsed configuration prior to a concrete pour. More specifically, the insert 20 is coupled to formwork 54 with fasteners, adhesive, or other like attachment devices or methods, including through second holes 52 in base plate 28 in some implementations. The location of the insert 20 relative to formwork 54 corresponds to the desired location of a void in the cured concrete, such as for rebar or other reinforcing to be placed before a subsequent concrete pour.

Figure 8:
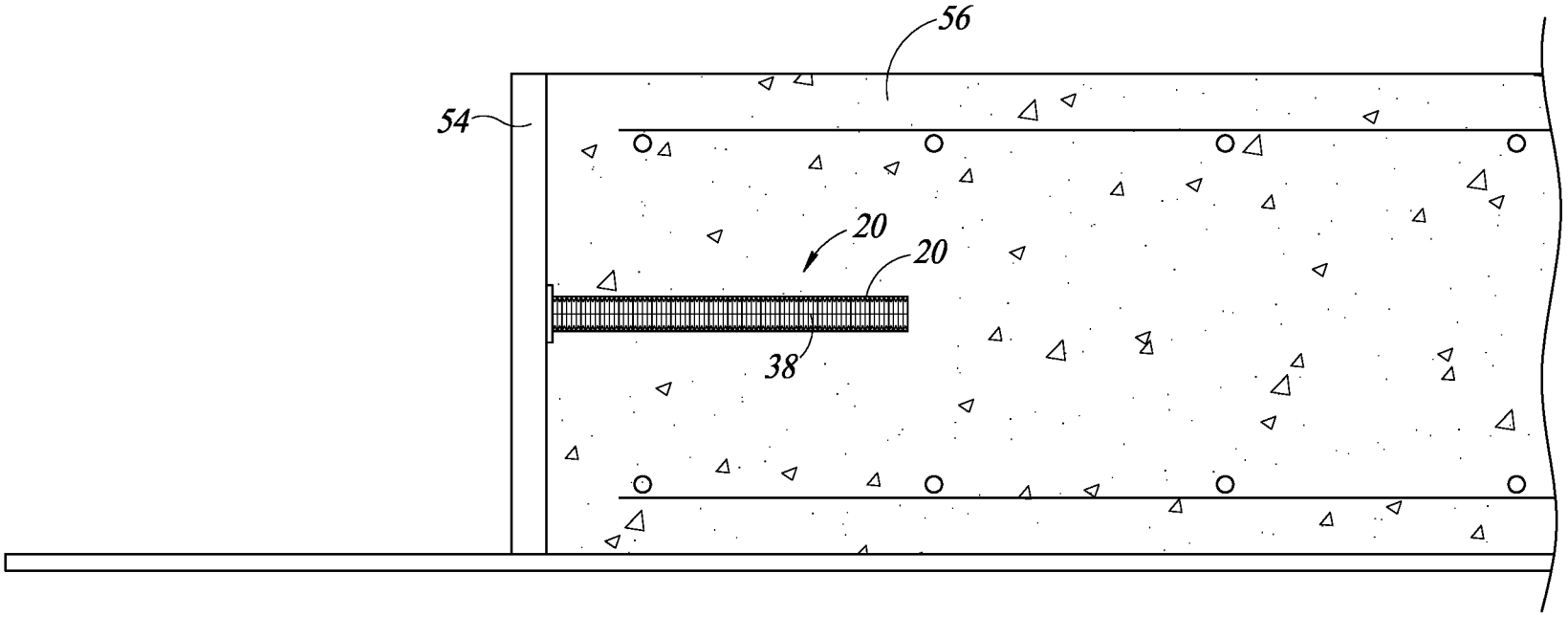

Then, in FIG. 8, concrete 56 is poured into formwork 54 and around the insert 20 in the collapsed configuration. The support 42 and attachment strip 48 (FIG. 3) as well as the connection strip 38 provide support for the tube 22 of the insert 20 to prevent the tube 22 from collapsing during the concrete pour.

Figure 9:
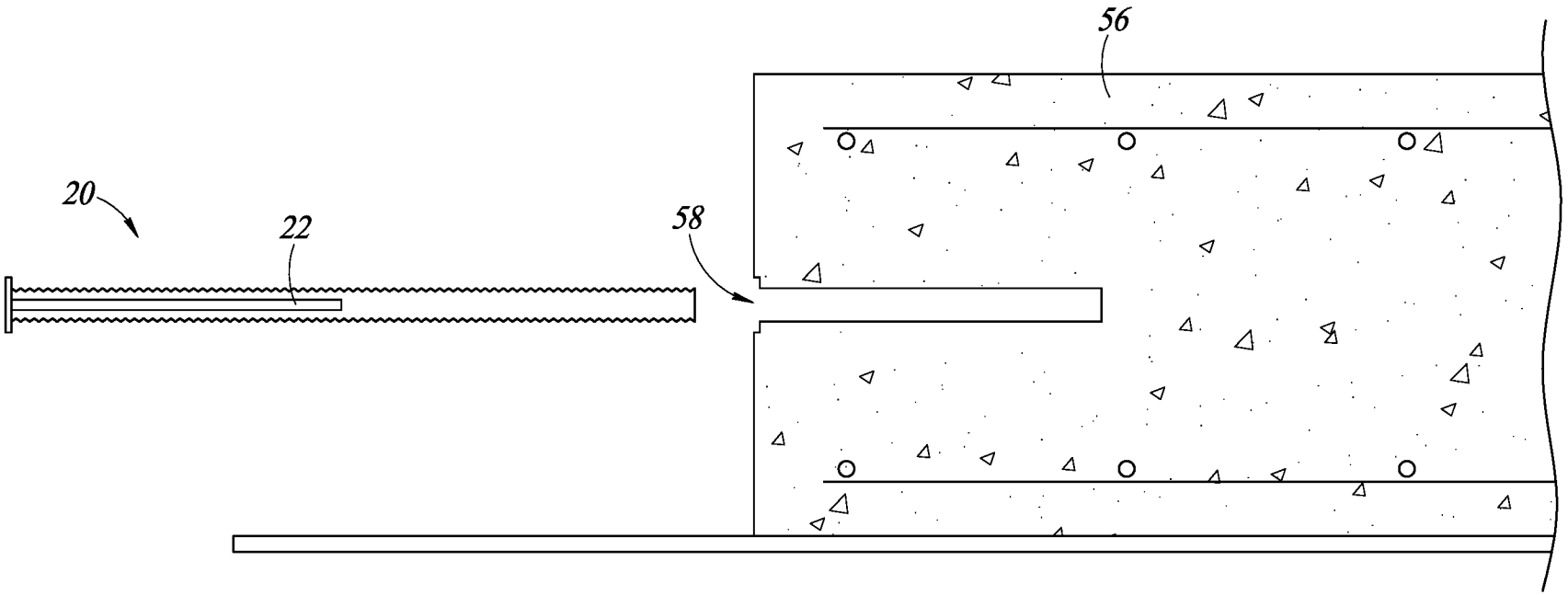

In FIG. 9, the concrete 56 is cured and the formwork 54 is removed, along with the insert 20. The insert 20 is attached to the formwork 54, such that removal of the formwork 54 extends the insert 20 from the collapsed configuration to the expanded configuration, as shown in FIG. 9. In the transition between the collapsed and expanded configurations, the attachment strip 48 (FIG. 6) breaks to allow the tube 22 to extend. Further, in some implementations, the tube 22 in the expanded configuration has a smaller diameter than the tube 22 in the collapsed configuration, such that the expanded tube 22 can be removed from the cured concrete 56, thus leaving a recess 58 (which may also be referred to herein as a hole, void, or cavity 58) in the cured concrete 56 in the shape of the insert 20. In one or more implementations, expansion of the tube 22 from the collapsed configuration to the extended configuration loosens the tube 22 from the cured concrete, such that the tube 22 can be removed to leave the recess 58. In some implementations, the tube 22 includes additional structures to assist with removing the tube 22 from the concrete 56, as described below.

Figure 10:
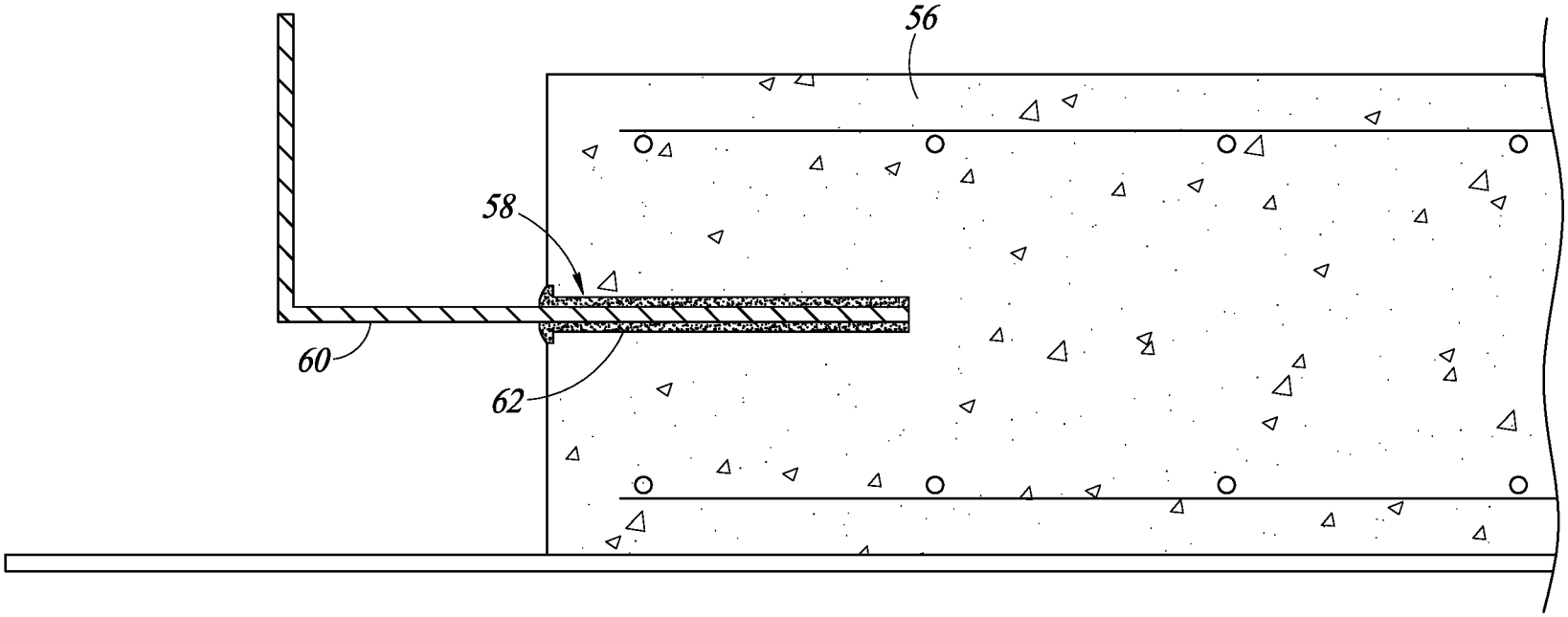

FIG. 10 illustrates the final step in the process wherein rebar or reinforcing metal 60, such as steel, is coupled to the cured concrete 56 with adhesive 62 in the recess 58 created by the insert. In some implementations, the adhesive 62 is placed in the recess 58 and the rebar 60 is inserted, such that when the adhesive 62 cures, the rebar 60 is fixed to the concrete 56 and ready to be used for a subsequent concrete pour.

Figure 11A:
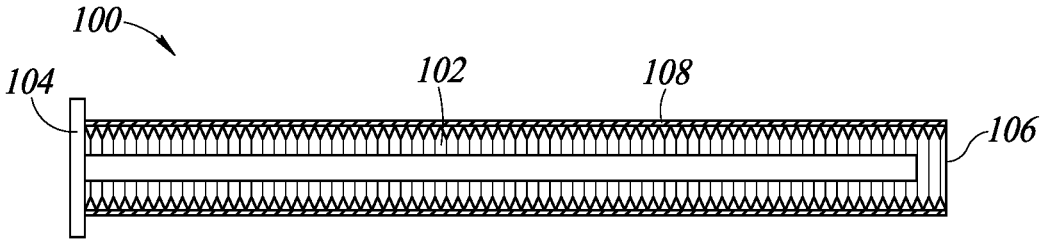
FIG. 11A is a cross-sectional view of an implementation of an insert for forming a void in concrete according to the present disclosure.
Figure 11B:
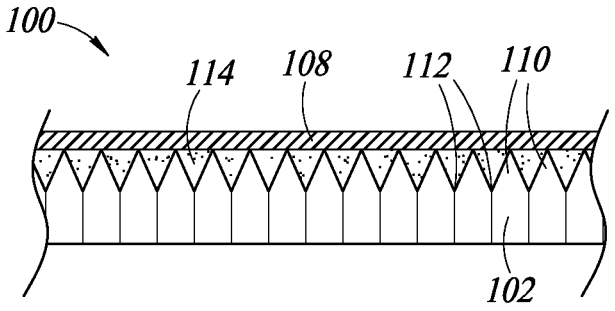
FIG. 11B is a detail view of a connection strip of the insert of FIG. 11A.

FIG. 11A and FIG. 11B illustrate one or more implementations of an insert 100 for forming a void in concrete that may be similar to insert 20, except as otherwise described herein. With reference to FIG. 11A, the insert 100 includes a tube 102 coupled to a base plate 104. The tube 102 includes a terminal end 106 and a connection strip 108 coupled to the tube 102 and extending along a side of the tube 102 from the base plate 104 to the terminal end 106. In other words, connection strip 108 is an additional strip of material coupled to the tube 102, instead of portions of the tube fused together as described above with reference to insert 20.

As shown more clearly in FIG. 11B, the tube includes a plurality of ridges 110 separated by a plurality of recesses 112. The connection strip 108 is coupled to the tube 102 with adhesive 114, which may be glue or tape, among other like materials. The connection strip 108 lays on top of the ridges 110, in some implementations, with the adhesive 114 filling the recesses 112. In one or more implementations, the connection strip 108 may be flexible, such that the connection strip 108 extends into the recesses 112 as well. In use, the insert 100 replaces the insert 20 in the method of FIGS. 7-10. After the concrete is cured, a force is applied to bias the base plate 104 away from the terminal end 106 of the tube 102, which breaks the connection strip 108 and allows for expansion of insert 100.

Figure 12:
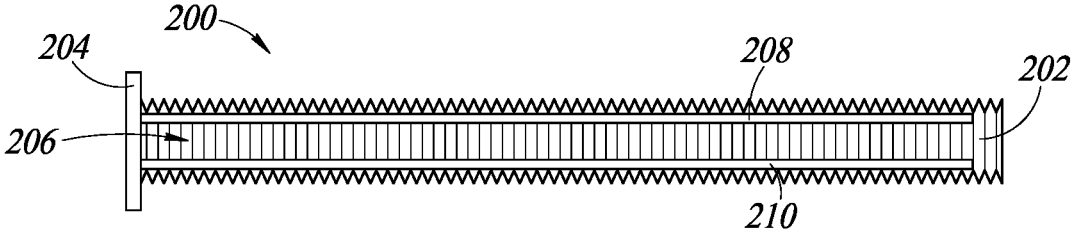
FIG. 12 is a cross-sectional view of an implementation of an insert for forming a void in concrete according to the present disclosure.

FIG. 12 is a cross-sectional view of one or more implementations of an insert 200 for forming a void in concrete, which may be similar to inserts 20, 100, except as otherwise described herein. The insert 200 includes a tube 202 coupled to a base plate 204 with an axial bore 206 extending into the tube 202. The insert 200 further includes a first support 208 and a second support 210 coupled to the base plate 204 and extending into the axial bore 206 of the tube 202.

In the illustrated implementation, the first and second supports 208, 210 extend in the axial bore 206 along a top and bottom of an inside of the tube 202. In other words, the first and second supports 208, 210 are on opposite sides of the tube 202. In use, the first and second supports 208, 210 provide support for the tube 202 during a concrete pour. In some implementations, the insert 200 does not include an attachment strip, but rather, the supports 208, 210 are secured only to the base plate 204. In one or more implementations, the supports 208, 210 are coupled to the inside of the tube 202, such as with adhesive or tape. Although FIG. 12 illustrates two supports 208, 210, there can be more or less than two supports 208, 210, such as only one support at the top of the tube 202, or four supports spaced equidistant around the inside of the tube 202, or three supports all arranged in the top half of the tube. A size and shape of the supports 208, 210 can be selected according to design specifications.

Figure 13A:
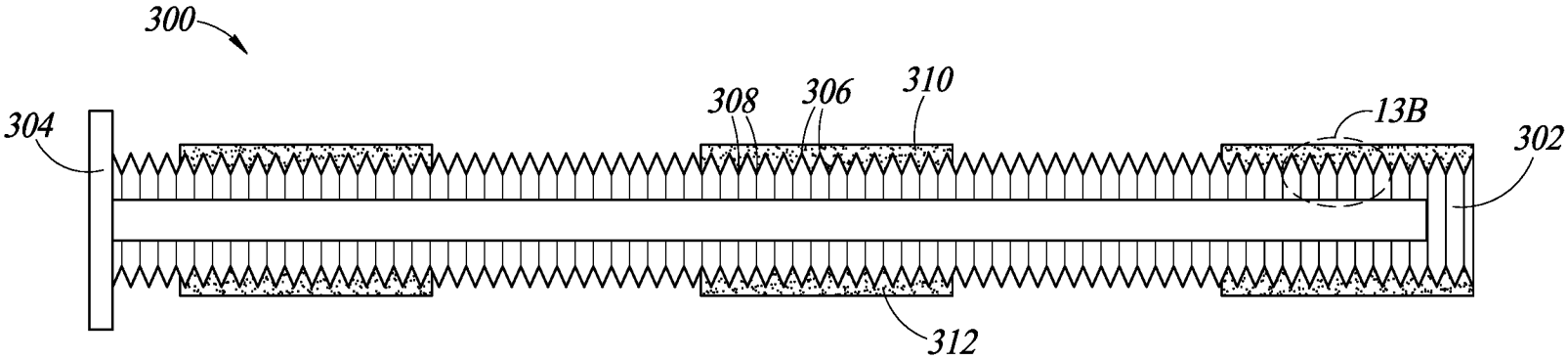
FIG. 13A is a cross-sectional view of an implementation of an insert for forming a void in concrete according to the present disclosure.
Figure 13B:
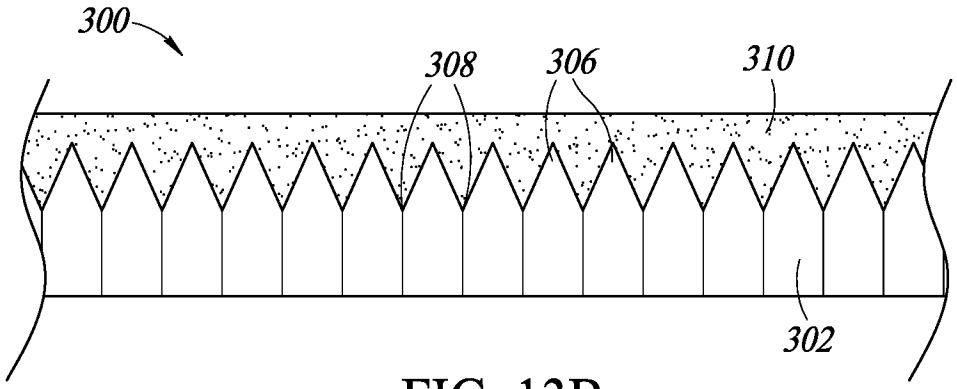
FIG. 13B is a detail view of a connection strip of the insert of FIG. 13A.

FIG. 13A is a cross-sectional view of one or more implementations of an insert 300 for forming a void in concrete, which may be similar to inserts 20, 100, 200, except as otherwise described herein. FIG. 13B is a detail view of a portion of the insert 300. With reference to FIG. 13A, the insert 300 includes a tube 302 coupled to a base plate 304. The tube 302 includes a plurality of ridges 306 separated by a plurality of recesses 308. The insert 300 further includes a first connection strip 310 and a second connection strip 312 extending along sides of the tube 302. Specifically, the first connection strip 310 extends along a top of the tube 302 and the second connection strip 312 extends along a bottom of the tube 302 in the illustrated implementation. However, it is to be appreciated that the location of the connection strips 310, 312 relative to the tube 302 can be selected according to design preference.

Further, there may be more or less than the two connection strips 310, 312 shown in FIG. 13A, such as only one connection strip, or three, four, five, six or more connection strips. The connection strips 310, 312 may be arranged on opposite sides of the tube 302 or spaced equidistant from each other or all arranged in or on a certain portion of the tube 302, such as all of the connection strips 310, 312 in the top half of the tube 302. In one or more implementations, the connection strips 310, 312 do not extend continuously along an entirety of the tube 302 as with other inserts described herein, but rather, are separated into portions that are spaced from each other along the tube 302, as shown. The position or location and number of the portions of the connection strips 310, 312 can be selected according to design specification.

FIG. 13B is a detail view of the first connection strip 310 of the insert 300. In particular, FIG. 13B illustrates that the first connection strip 310 is a layer of material, such as adhesive, that is applied over the ridges 306 and recesses 306 along the tube 302. In other words, in some implementations, the connection strip 310 is formed of glue that fills the recesses 306 and breaks when the tube 302 is extended, as described herein. Although FIG. 13A and FIG. 13B illustrate the first connection strip 310 filling the recesses 308 and extending beyond the ridges 306, one or more implementations of the present disclosure include the adhesive comprising the first connection strip 310 in the recesses 308, but not extending above the ridges 306. Further, the first connection strip 310 may be planar with tops of the ridges, in some implementations.

Figure 14A:
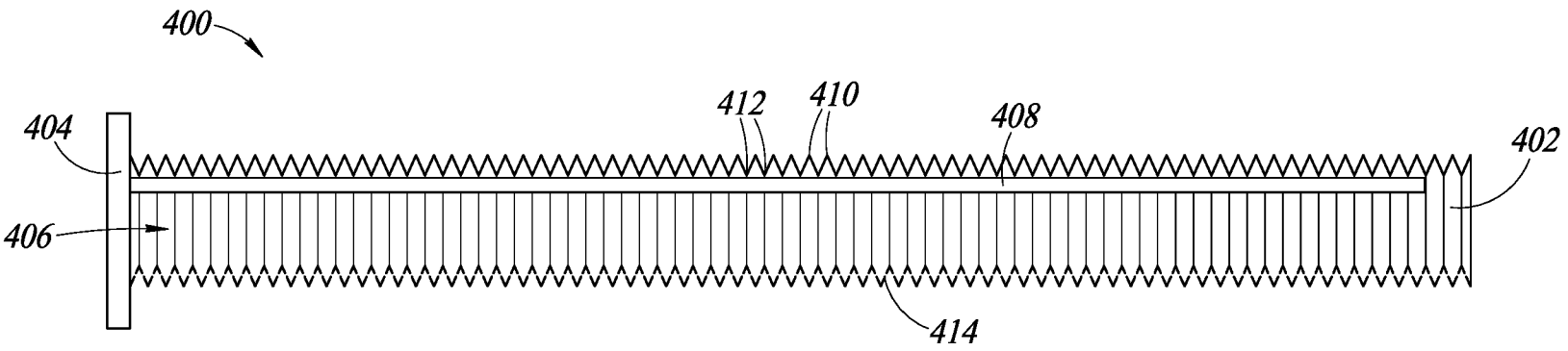
FIG. 14A is a cross-sectional view of an implementation of an insert for forming a void in concrete according to the present disclosure.
Figure 14B:
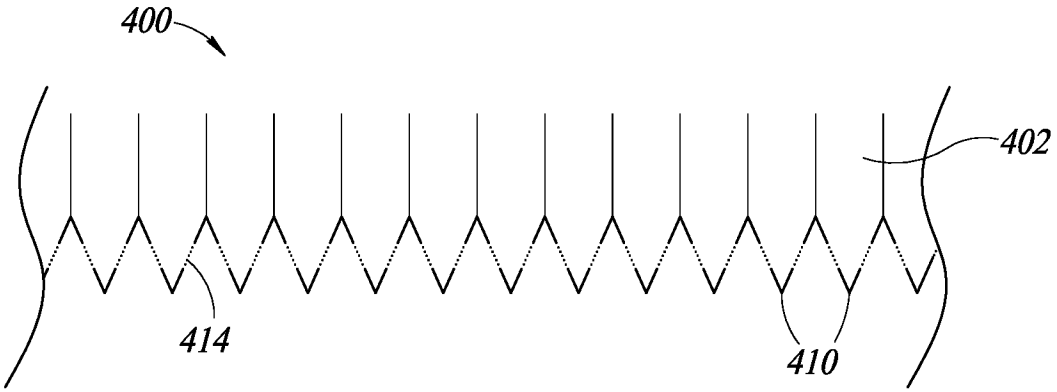
FIG. 14B is a detail view of a break line in the insert of FIG. 14A.

FIG. 14A is a cross-sectional view of one or more implementations of an insert 400 for forming a void in concrete, which may be similar to inserts 20, 100, 200, 300, except as otherwise described herein. FIG. 14B is a detail view a portion of the insert 400. Beginning with FIG. 14A, the insert 400 includes a tube 402 coupled to a base plate 404 and a support 408 coupled to the base plate 404 and extending into the axial bore 406. In one or more implementations, there is only one support 408 that extends into the axial bore 406 along a top of the inside of the tube 402, as shown. However, the support 408 could also extend along one of the sides of the tube 402 or the bottom of the tube 402 in some implementations. The tube 402 further includes a plurality of ridges 410 separates by a plurality of recesses 412 that extend around an entire periphery of the tube 402. Further, the tube 402 includes a break line 414 through the ridges 410.

FIG. 14B illustrates additional detail of the break line 414 of the insert 400. As shown in FIG. 14B, the insert 400 includes a break line 414 through the ridges 410. In the illustrated implementation, the break line 414 is at the bottom of the tube 402, although the break line 414 could be at any position relative to the tube 402 in one or more implementations. The break line 414 is a series of perforations through the ridges 410 that make it easier to break the tube 402 when removing the insert 400 from cured concrete. In other words, once the concrete cures, the tube 402 is broken along the break line 414, such that the diameter of the tube 402 can be reduced to assist in removing the insert 400 from the concrete.

In some implementations, the tube 402 includes a pull tab connected to the break line 414 to assist with breaking the tube 402 along the break line 414. The pull tab may be connected to the break line 414 and may extend through a hole in the base plate 404, such as hole 50 described with reference to insert 20 in FIG. 4. In operation, the concrete cures with the insert 400 in place and then the operator pulls the pull tab, which breaks the tube 402 along break line 414. Once the tube 402 breaks, the operator can pull on the base plate 404, and the tube 402 will reduce in diameter via the break to assist in removing the insert 400 from cured concrete. In one or more implementations, the insert 400 does not include a pull tab, but rather, the break line 414 is designed to fail upon application of force on the tube base plate 404 in a direction away from the tube 402. In addition, there could be only one break line 414, or multiple break lines 414 along the tube 402 in some implementations. The position and size of the break lines 414 can be selected according to design specification.

Figure 15:
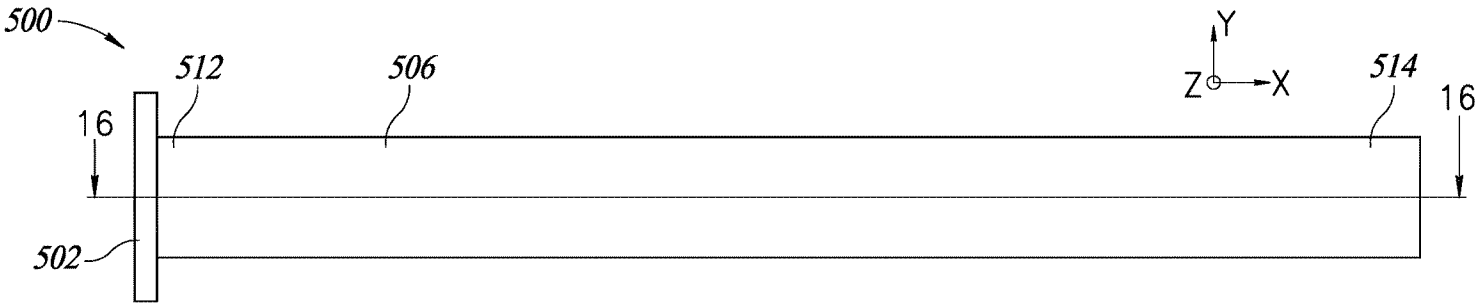
FIG. 15 is a side elevation view of an implementation of an insert for forming a void in concrete with a rod and sleeve according to the present disclosure.
Figure 16:
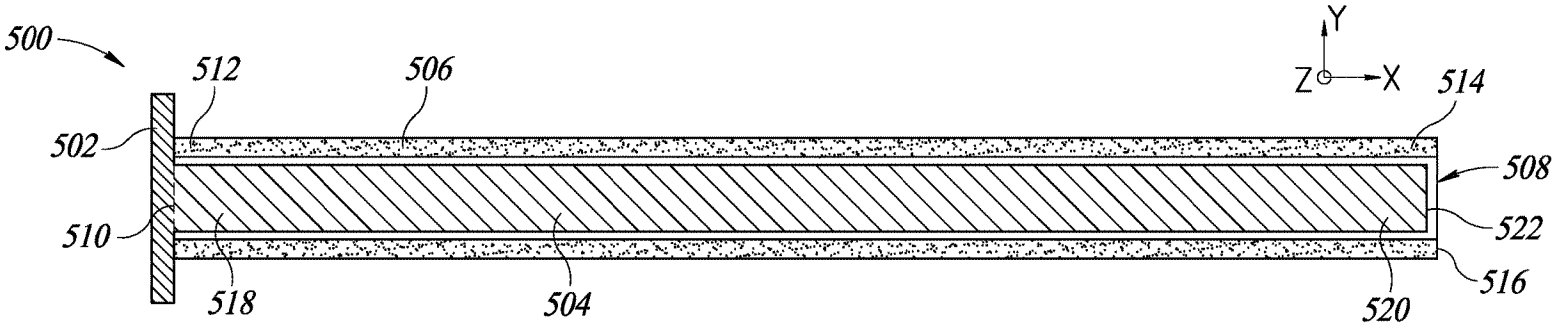
FIG. 16 is a cross-sectional view of the insert of FIG. 15 along line 16-16 in FIG. 15.

FIG. 15 is a side view of one or more implementations of a device 500 for forming a void in concrete and FIG. 16 is a cross-sectional view of the device 500 along line 16-16 in FIG. 15. With reference to FIG. 15 and FIG. 16, the device 500 includes a base 502 and an elongate rod or tube 504 coupled to the base 502 and extending from a center of the base 502 in an axial direction along axis X. A sleeve 506 is positioned on the rod 504 with the rod 504 contained completely within the sleeve 506 in some implementations. Put differently, the sleeve 506 includes an axial bore 508 through the sleeve 506 with the rod 504 received in the axial bore 508 and positioned internal to the sleeve 506. The rod 504 may be a separate and independent component that is coupled to the base 502 with fasteners or adhesive or the base 502 and the rod 504 may be a single, integral, unitary component as indicated by dashed lines 510 between the base 502 and the rod 504 of the device 500 in FIG. 16.

The sleeve 506 is positioned on the rod 504 with a first end 512 of the sleeve 506 proximate to, adjacent to, or in abutting contact with the base 502 in some implementations. The sleeve 506 is not necessarily physically or mechanically coupled to the rod 504, but rather, the sleeve 506 rests on the rod 504 and can be removed by pulling on the sleeve 506. In other words, an internal diameter of the axial bore 508 of the sleeve 506 may be greater than, equal to, or less than an outer diameter of the rod 506 such that the sleeve 506 floats on the rod 504 or engages the rod 504 with a friction fit. In some implementations, the sleeve 506 is coupled directly to the rod 504 or the base 502, or both, which coupling may include break lines or tabs of the type described herein to assist with separating the rod 504 from the sleeve 506.

The sleeve 506 further includes a second end 514 opposite to the first end 512. The first end 512 of the sleeve 506 may also be referred to herein as a proximal end 512 and the second end 514 may be referred to as a distal end 514. The second end 514 of the sleeve 506 extends away from the base 502 in an axial direction along axis X and terminates at an outer peripheral edge 516 of the sleeve 506. The rod 504 includes a first or proximal end 518 coupled to the base 502 and a second or distal end 520 opposite the first end 518 that terminates in an outer peripheral edge 522 of the rod 504. As shown in FIG. 16, the sleeve 506 may extend beyond the outer peripheral edge 522 of the rod 504. More specifically, the outer peripheral edge 516 of the sleeve 506 extends further from the base 502 than the outer peripheral edge 522 of the rod 504. This arrangement assists with uncoupling the rod 504 from the sleeve 506 in operation, as explained further below. In some implementations, the outer peripheral edges 516, 522 of the sleeve 506 and the rod 504, respectively, are aligned or coplanar with each other, or the outer peripheral edge 522 of the rod 504 may extend further from the base 502 than the outer peripheral edge 516 of the sleeve 506.

The base 502 and the rod 504 may be formed of any material described herein and may include, in some non-limiting examples, plastic, rubber, thermoplastics, polymers, metal, wood, alone or in combination, and other like materials. Further, the base 502 and rod 504 can be formed by conventional manufacturing methods. In some implementations, the sleeve 506 is formed from the same material as the base 502 and the rod 504 while in other implementations, the sleeve 506 has a different material composition. In one non-limiting example, the sleeve 506 may be clear plastic tubing while the base 502 and rod 504 are polyvinyl chloride ("PVC") or metal. Further, the base 502, the rod 504, and the sleeve 506 may have any selected color. In some non-limiting examples, the sleeve 506 may not be clear, but rather, is colored for identification purposes, such as the sleeve 506 having a color corresponding to its size or length.

Further, as shown in FIG. 15 and FIG. 16, both the rod 504 and the sleeve 506 have a constant and continuous diameter over their respective lengths. The lengths and the diameters of the rod 504 and the sleeve 506 can be selected according to design factors, such as the desired size (diameter) and depth of the void left by the device 500 in cured concrete in one non-limiting example. The constant diameter of the rod 504 assists with removing the rod 504 from the sleeve 506 and the constant diameter of the sleeve 506 assists with removing the sleeve 506 from cured concrete. The rod 504 and the sleeve 506 may be straight and extend in the axial direction X indicated in FIG. 15 and FIG. 16. In some implementations, the axial direction X is parallel to horizontal such that the rod 504 and tube 506 generally extend horizontally. The base 502 extends radially outward from the rod 504 at the first end 518 of the rod 504 such that the base 502 is perpendicular to the rod 504.

In one or more implementations, the rod 504 and the sleeve 506 are at an angle to the base 502 and the axial direction X. In some non-limiting examples, the rod 504 and the sleeve 506 may be at an angle of 15 degrees, 30 degrees, 45 degrees, or 60 degrees, or more or less relative to the base 502 and the axial direction X. The angle may be positive or negative (i.e., above or below the axial direction X) and may be any selected value based on design factors. In such implementations, the angle of the rod 504 and the sleeve 506 create a corresponding angled or bent void in the cured concrete for receiving angled or bent rebar.

Figure 17:
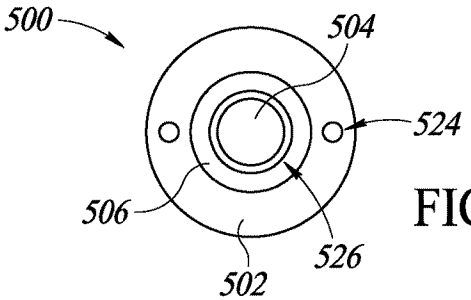
FIG. 17 is an end view of the insert of FIG. 15.

FIG. 17 is an end plan view of the device 500 from the second end 514 of the sleeve 506 and the second end 520 of the rod 504 shown in FIG. 16. As shown in FIG. 17, the base 502 has a generally circular shape while the rod 504 and the sleeve 506 have a cylindrical shape in order to form a round or cylindrical void in cured concrete that more easily facilitates the installation of rebar into the void, as described herein. The shape of the base 502, the rod 504, and the sleeve 506 may also be selected to be different from that shown in FIG. 17 according to design factors. The base 502 includes holes 524 through the base 502 for coupling the base 502 and the device 500 to concrete formwork. In some implementations, the holes 524 include exactly and only two holes 524 through the base 502 on opposite sides of the rod 504. In one or more implementations, the holes 524 include more or less than two holes 524 and in any position with respect to the base 502. For example, the holes 524 may having an irregular spacing with multiple holes on opposite sides of the rod 504 or the holes 524 may be spaced equidistant from each other about the rod 504.

FIG. 17 further illustrates the positioning of the sleeve 506 relative to the rod 504 and more particularly, shows an air gap or space 526 between the rod 504 and the sleeve 506. Thus, as described above, the sleeve 506 rests or floats on the rod 504 in some implementations, meaning in this context only that there is the gap or space 526 between the rod 504 and the sleeve 506 with no physical or mechanical coupling between the rod 504 and the sleeve 506. In some implementations, the air gap or space 526 extends the entire length of the rod 504 and the sleeve 506 as a result of the constant diameters of the rod 504 and the sleeve 506. When the rod 504 and the sleeve 506 are arranged along the axial direction X, the air gap or space 526 may be only on one side of the rod 504 (i.e., the bottom side relative to axial direction X) with the other side of the rod 504 in contact with the sleeve 506 due to the effects of gravity.

Figure 18:
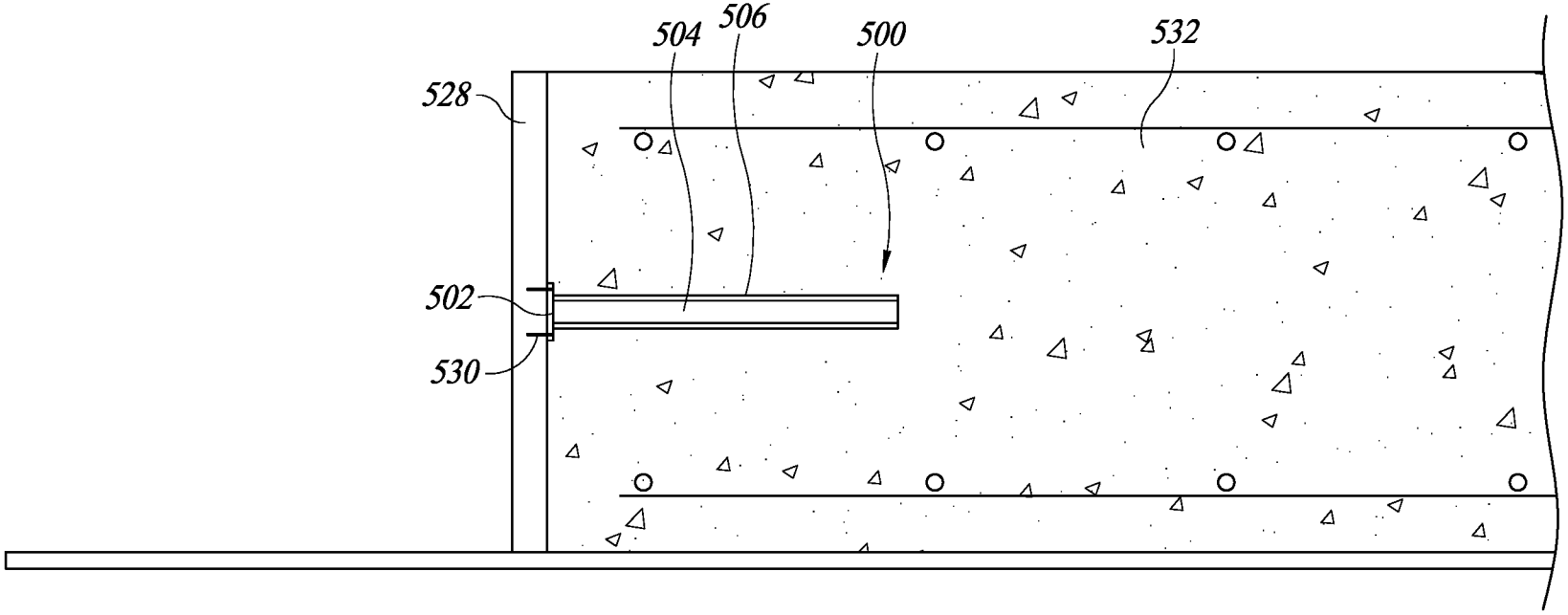
FIGS. 18-20 are schematic cross-sectional views of various process steps in an implementation of a method of forming a void in concrete according to the present disclosure.
Figure 19:
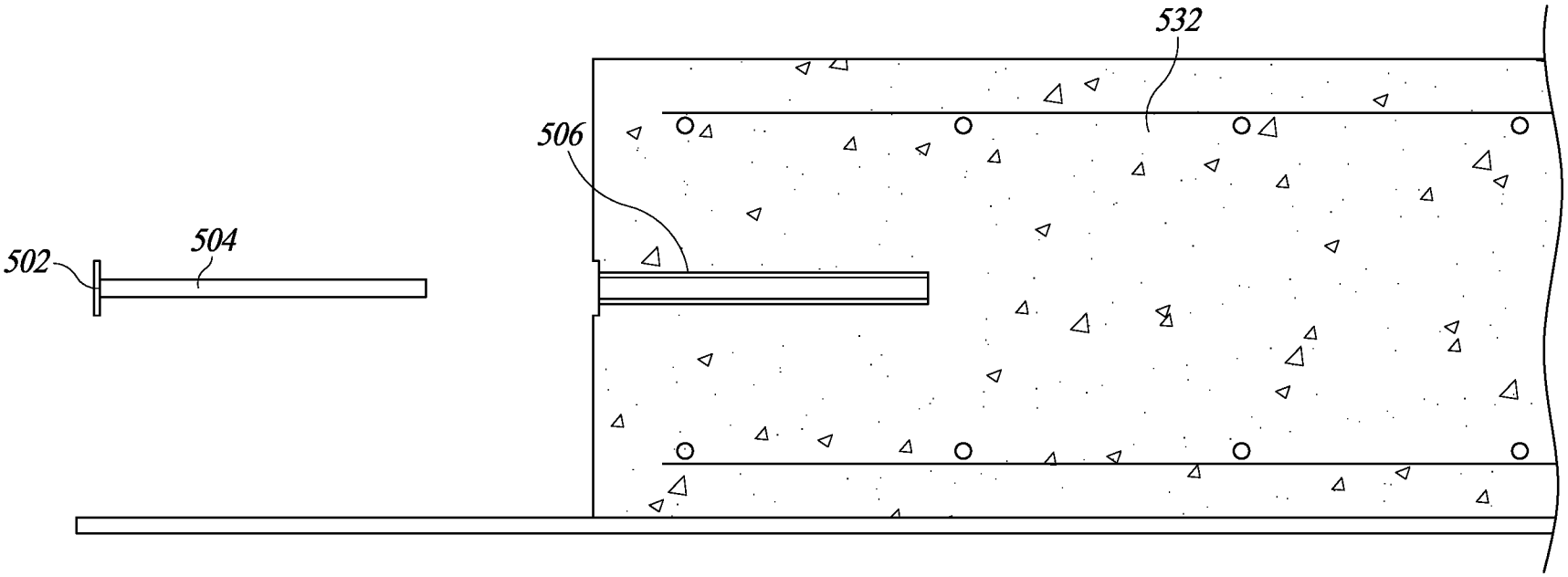
Figure 20:
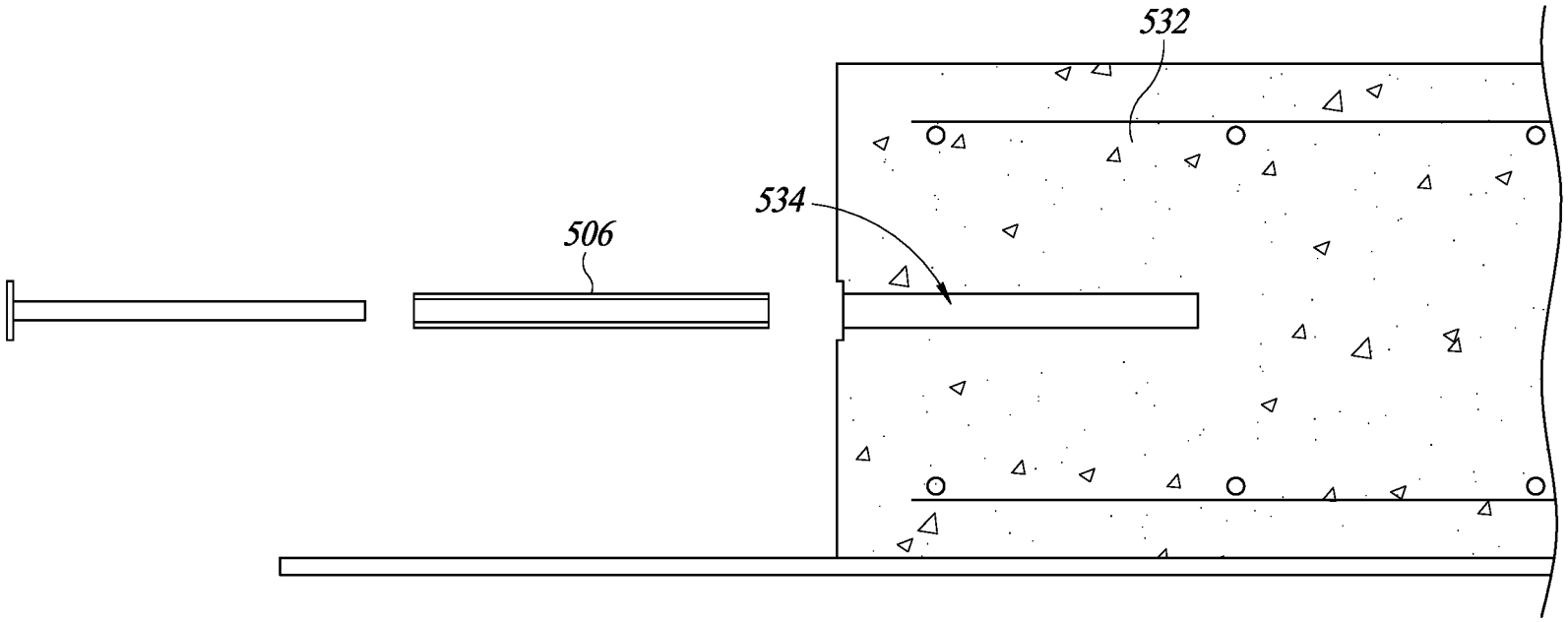

FIGS. 18-20 are schematic cross-sectional views of various process steps in an implementation of a method of forming a void in concrete using device 500. Beginning with FIG. 18, the method includes positioning the sleeve 506 on the rod 504 and coupling the base 502 of the device 500 to formwork 528 with fasteners 530 through holes 524 (FIG. 17) in the base 502. Concrete 532 is poured and cured around the device 500 and the sleeve 506 as described herein.

Then, in FIG. 19, the base 502 and the rod 504 are removed from the sleeve 506 in a first step with the sleeve 506 remaining in the cured concrete 532. Thus, the advantage is that the sleeve 506 makes it easier to remove the rod 504 from the cured concrete 532. In other words, without the sleeve 506, the rod 504 may be difficult to remove from the cured concrete 532 and particularly where the rod 504 is selected to have a large diameter (greater than 2 inches) or a long length (greater than 18 inches), or both. The base 502 can also be uncoupled from the formwork 528 and the base 502 and rod 504 used again in a different application or the base 502 can remain coupled to the formwork 528 for repeated use of the base 502 and the rod 504 with formwork 528 (FIG. 18).

After the rod 504 is removed, the sleeve 506 is removed from the concrete 532 in a second step shown in FIG. 20. In some implementations, the sleeve 506 has a smooth outer surface with a low coefficient of friction (less than 1.0, less than 0.5, or less than 0.10 in various implementations) such that the sleeve 506 can be removed from the concrete 532 to leave a void 534 in the concrete 532 with a shape of the base 502 and the sleeve 506. The sleeve 506 may also have a lower coefficient of friction than the rod 504 to assist with removing the sleeve 506 from the concrete 532.

Further, the sleeve 506 may include an elastic material such that the sleeve 506 will deform along the axial direction X under tensile forces or stress. In some implementations, the sleeve 506 is clear plastic tubing with a modulus of elasticity between 1 and 4 Gigapascals (GPa). The amount of deformation depends on the thickness of the sleeve 506 and the thickness of the sleeve 506 can be selected to result in more or less deformation according to design factors. Thus, in some implementations, when a tensile force is applied to the first end 512 (FIG. 16) of the sleeve 506 with the remainder of the sleeve 506 in the concrete 532, the sleeve 506 expands or deforms slightly. The expansion of the sleeve 506 in the axial direction X (FIG. 16) reduces the outer diameter of the sleeve 506 to assist with removing the sleeve 506 from the concrete 532.

Because the rod 504 may have a different material composition that is more rigid and less elastic than the sleeve 506, the composition of the sleeve 506 provides an advantage in removing the device 500 from cured concrete 532 relative to using only the rod 504. In some implementations, the rod 504 may be selected to have a similar material composition to the sleeve 506 and may be elastic in order to produce similar results using only the rod 504. However, this is a less preferred implementation as using an elastic material for the rod 504 can lead to failure of the rod 504 or the connection between the rod 504 and the base 502 when removing the rod 504 directly from the concrete 532.

Thus, implementations of the present disclosure avoid the pitfalls of known methods and devices for joining concrete pours because no concrete drilling is required for installation, there are no issues with installing bent or angled reinforcing bars, the inserts 20, 100, 200, 300, 400, 500 described herein can be made from low-cost materials, and installation of the inserts 20, 100, 200, 300, 400, 500 and performance of the methods described herein can be achieved with comparatively less labor hours than known methods. Further, one of skill in the art will understand that because the size, shape, orientation and dimensions of the inserts 20, 100, 200, 300, 400, 500 can be customized to correspond to a size, shape, orientation, and dimension of reinforcing bars to be inserted into voids left by the inserts 20, 100, 200, 300, 400, 500 that implementations of the present disclosure also provide a more adaptable and flexible solution to forming voids in concrete. Accordingly, implementations of the present disclosure achieve a cost-effective, efficient, and safe mechanism for forming voids in concrete to receive reinforcing bars such that multiple pours or phases of concrete structures can be more easily, efficiently, and effectively joined together.

In the foregoing description, certain specific details are set forth in order to provide a thorough understanding of various disclosed implementations. However, one skilled in the relevant art will recognize that the present disclosed implementations may be practiced without one or more of these specific details, or with other methods, components, materials, etc. In other instances, well-known structures or components, or both, that are associated with the environment of the present disclosure have not been shown or described in order to avoid unnecessarily obscuring descriptions of the implementations.

Unless the context requires otherwise, throughout the specification and claims that follow, the word "comprise" and variations thereof, such as "comprises" and "comprising," are to be construed in an open inclusive sense, that is, as "including, but not limited to." The foregoing applies equally to the words "including" and "having."

Reference throughout this description to "one implementation" or "an implementation" means that a particular feature, structure, or characteristic described in connection with the implementation is included in at least one implementation. Thus, the appearance of the phrases "in one implementation" or "in an implementation" in various places throughout the specification are not necessarily all referring to the same implementation. Furthermore, the particular features, structures, or characteristics may be combined in any suitable manner in one or more implementations.

In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

The invention claimed is:

1. A device for forming a void in cured concrete, comprising:

a base having at least one hole through the base;

a rod coupled to the base and extending from the base in an axial direction; and a sleeve positioned on the rod and having a longitudinal axial bore extending from a first end of the sleeve to and through a second end of the sleeve, the axial bore of the sleeve sized and shaped to receive the rod in slidable engagement within the axial bore with the rod positioned internal to the sleeve, the rod structured to be removed from the axial bore of the sleeve and the sleeve structured to be removed from the cured concrete to form the void in the cured concrete, wherein the sleeve is composed of a resilient material, an entirety of the sleeve having a smooth outer surface, the sleeve structured to extend in the axial direction in response to a tensile force on the sleeve in the axial direction during removal of the sleeve from the cured concrete, wherein the sleeve has a constant inner and outer diameter over an entire length of the sleeve; and wherein the sleeve is structured to return to an original length of the sleeve in response to removal of the tensile force on the sleeve after removal of the sleeve from the cured concrete to enable reuse of the sleeve.

2. The device of claim 1 wherein the at least one hole includes only two holes.

3. The device of claim 1 wherein the base and the rod are a single, unitary, integral component and the sleeve is an independent component removably positioned on the rod.

4. The device of claim 1 further comprising:

an air gap between the rod and the sleeve.

5. The device of claim 1 wherein the rod has a first coefficient of friction and the sleeve has a second coefficient of friction less than the first coefficient of friction.

6. The device of claim 1 wherein the rod has a length and the length of the sleeve is greater than or equal to the length of the rod.

7. The device of claim 6 wherein the rod has a diameter that is constant over an entirety of the length of the rod, and the constant diameter of the rod is less than the constant diameter of the sleeve to form an air gap between the rod and the sleeve.

8. A device for forming a void having a diameter in cured concrete, comprising:

a circular base having at least one hole through the base;

an elongate rod having a first end, a second end, and a length along an axial direction from the first end to the second end of the elongate rod, the first end of the elongate rod coupled to the base and the second end of the elongate rod spaced from the base across the length of the elongate rod; and a sleeve having a first end, a second end, and a longitudinal axial bore extending from the first end to and through the second end of the sleeve, the axial bore sized and shaped to receive the elongate rod in slidable engagement within the axial bore, the sleeve having a length along the axial direction between the first end and the second end of the sleeve, the length of the sleeve being greater than or equal to the length of the elongate rod, the elongate rod having a diameter less than a diameter of the sleeve to form an air gap between the elongate rod and the sleeve in response to the elongate rod being slidably received within the longitudinal axial bore of the sleeve, wherein the sleeve is composed of an elastic material, an entirety of the sleeve having a smooth outer surface, wherein the diameter of the sleeve includes a constant and continuous outer and inner diameter over an entire length of the sleeve in a resting position, and wherein the sleeve is structured to stretch from the resting position to an extended position where the sleeve has a reduced diameter and an extended length relative to the resting position in response to application of a tensile force on the sleeve in the axial direction during removal of the sleeve from the cured concrete, and the sleeve is further structured to compress and return to an original length and an original diameter in the resting position in response to removal of the tensile force on the sleeve to enable repetitive use of the sleeve.

9. The device of claim 8 wherein the air gap is between the elongate rod and sleeve over an entire length of the elongate rod and an entire length of the sleeve.

10. The device of claim 8 wherein the at least one hole through the circular base includes only two holes.

11. The device of claim 8 wherein the diameter of the elongate rod is constant over an entire length of the elongate rod.

12. The device of claim 8 wherein the elongate rod is structured to be removed from the axial bore of the sleeve and the sleeve is structured to be removed from the cured concrete to leave the void in the cured concrete.

13. The device of claim 8 wherein the outer diameter of the sleeve is substantially equal to the diameter of the void in the cured concrete.

14. A method of forming a void in cured concrete, comprising:

providing a base having at least one hole in the base;

providing an elongate rod coupled to the base and extending from the base in an axial direction;

providing a sleeve composed of a resilient material, the sleeve having a longitudinal axial bore extending from a first end of the sleeve to and through a second end of the sleeve, an entire length of the sleeve having a constant inner and outer diameter, and an entirety of the sleeve having a smooth outer surface;

placing the sleeve on the elongate rod, including positioning the elongate rod in the axial bore of the sleeve and internal to the sleeve with the axial bore sized and shaped to receive the elongate rod in slidable engagement with the axial bore;

coupling the base to concrete formwork;

pouring concrete over the sleeve and the elongate rod, including allowing the concrete to cure;

removing the elongate rod from the sleeve;

removing the sleeve from the cured concrete to form the void, including extending the sleeve in the axial direction and reducing the outer diameter of the sleeve in response to a tensile force on the sleeve in the axial direction; and removing the tensile force on the extended sleeve in the axial direction following removal of the sleeve from the cured concrete to return the sleeve to an original length of the sleeve and enable reuse of the sleeve.

15. The method of claim 14 wherein placing the sleeve on the elongate rod includes positioning an outer peripheral edge of the sleeve coplanar with, or extending beyond, an outer peripheral edge of the elongate rod.

16. The method of claim 14 wherein placing the sleeve on the elongate rod includes the elongate rod having a diameter less than the constant diameter of the sleeve to form an air gap between the sleeve and the elongate rod with the air gap extending over the entire length of the sleeve and an entire length of the elongate rod.

17. The method of claim 14 wherein coupling the base to the concrete formwork includes inserting a fastener through said at least one hole in the base.

* * * * *